US011421876B2

(12) United States Patent
Costa et al.

(10) Patent No.: US 11,421,876 B2
(45) Date of Patent: Aug. 23, 2022

(54) METHOD FOR REGULATING A HEATING DEVICE AND HEATING DEVICE

(71) Applicant: BOSCH TERMOTECNOLOGIA S.A., Cacia Aveiro (PT)

(72) Inventors: Hugo Jose Magalhaes Costa, Oporto (PT); Luis Miguel Monteiro Pacheco, Aveiro (PT); Mauro André Oliveira Simoes, Num 10 B 3 Dto (PT); Ricardo Miguel Santos Heleno, Assentiz Tnv (PT)

(73) Assignee: BOSCH TERMOTECNOLOGIA S.A., Cacia Aveiro (PT)

( * ) Notice: Subject to any disclaimer, the term of this patent is extended or adjusted under 35 U.S.C. 154(b) by 0 days.

(21) Appl. No.: 17/046,717

(22) PCT Filed: Aug. 30, 2019

(86) PCT No.: PCT/EP2019/073231
§ 371 (c)(1),
(2) Date: Oct. 9, 2020

(87) PCT Pub. No.: WO2020/043887
PCT Pub. Date: Mar. 5, 2020

(65) Prior Publication Data

US 2021/0164658 A1 Jun. 3, 2021

(30) Foreign Application Priority Data

Aug. 30, 2018 (PT) ..... 111114

(51) Int. Cl.
*F23N 5/18* (2006.01)
*F23N 5/26* (2006.01)

(52) U.S. Cl.
CPC ..... *F23N 5/18* (2013.01); *F23N 5/187* (2013.01); *F23N 5/265* (2013.01);
(Continued)

(58) Field of Classification Search
CPC ..... F23N 5/18; F23N 5/187; F23N 5/265; F23N 2223/08; F23N 2223/44;
(Continued)

(56) References Cited

U.S. PATENT DOCUMENTS 3,262,485 A * 7/1966 Arthur ..... G05D 7/0635 236/14
4,770,627 A * 9/1988 Yoshino ..... F23D 5/045 431/18

(Continued)

FOREIGN PATENT DOCUMENTS

DE 19945562 A1 * 4/2001 ..... F23N 5/16
DE 10159033 A1 * 9/2002 ..... F23N 3/082

(Continued)

OTHER PUBLICATIONS

"EP_2888530_B1_M—Machine Translation.pdf", machine translation, EPO.org, Sep. 30, 2021. (Year: 2021).*

(Continued)

*Primary Examiner* — Steven B McAllister
*Assistant Examiner* — Daniel E. Namay
(74) *Attorney, Agent, or Firm* — Norton Rose Fulbright US LLP; Gerard A. Messina

(57) ABSTRACT

Methods for regulating a heating device, which includes a combustion chamber, into which combustion air is introduced via a controllable blower. An operating variable and a speed of the blower are measured. An operating coefficient is determined on the basis of the measured operating variable and the measured speed. A volume flow coefficient is determined on the basis of reference values for the operating coefficient. A volume flow of the combustion air being determined on the basis of the volume flow coefficient. A calibration of the reference values is carried out for the operating coefficient.

9 Claims, 3 Drawing Sheets

(52) U.S. Cl.
CPC .... *F23N 2005/181* (2013.01); *F23N 2223/04* (2020.01); *F23N 2223/08* (2020.01); *F23N 2223/10* (2020.01); *F23N 2223/44* (2020.01); *F23N 2227/20* (2020.01)

(58) Field of Classification Search
CPC ..... F23N 2223/10; F23N 2223/04; F23N 2227/20; F23N 2005/181; F23N 3/002; F23N 3/005; F23N 3/007; F23C 7/008; F23D 2208/005; F23L 2900/07006
USPC ..... 431/12
See application file for complete search history.

(56) References Cited

U.S. PATENT DOCUMENTS 5,248,083 A * 9/1993 Adams ..... F23N 1/062 236/11
5,401,162 A * 3/1995 Bonne ..... F23N 1/022 431/12
5,511,971 A * 4/1996 Benz ..... F23N 5/003 431/9
5,524,556 A * 6/1996 Rowlette ..... F23N 1/06 110/162
5,549,152 A * 8/1996 Davis, Jr. ..... G05B 13/0275 165/201
5,616,995 A * 4/1997 Hollenbeck ..... H02P 6/08 110/162
5,626,085 A * 5/1997 Donais ..... F23N 1/022 110/189
5,676,069 A * 10/1997 Hollenbeck ..... H02K 29/03 126/116 A
5,680,021 A * 10/1997 Hollenbeck ..... F23N 3/082 318/434
5,682,826 A * 11/1997 Hollenbeck ..... H02P 6/085 110/147
5,720,231 A * 2/1998 Rowlette ..... F23N 1/06 110/162
5,806,440 A * 9/1998 Rowlette ..... F23N 3/082 110/162
6,039,261 A * 3/2000 Pavese ..... F23N 5/006 236/14
6,776,609 B1 * 8/2004 Sullivan ..... F23N 5/18 431/9
7,101,172 B2 * 9/2006 Jaeschke ..... F23N 3/08 431/19
7,735,743 B2 * 6/2010 Jaeschke ..... F23N 5/18 236/11
8,091,795 B1 * 1/2012 McLellan ..... G05D 23/1923 236/51
9,028,245 B2 * 5/2015 Fan ..... F23N 5/006 431/12
9,791,172 B2 * 10/2017 Wang ..... F23N 5/187
10,260,746 B2 * 4/2019 Lochschmied ..... F04D 29/4213
10,323,966 B2 * 6/2019 Yokohata ..... G01F 15/04
10,352,562 B2 * 7/2019 Lochschmied ..... F23N 1/022
10,591,161 B2 * 3/2020 Super ..... F23N 5/187
10,704,942 B2 * 7/2020 Kitano ..... G06Q 50/06
2001/0051321 A1 * 12/2001 La Fontaine ..... F23N 1/022 431/12
2004/0043345 A1 * 3/2004 Jaeschke ..... F23N 3/08 431/18
2007/0003891 A1 * 1/2007 Jaeschke ..... F23N 5/18 431/19
2008/0057451 A1 * 3/2008 Fujiwara ..... F23N 3/002 431/12
2011/0212404 A1 * 9/2011 Fan ..... F23N 5/006 431/12
2015/0233578 A1 * 8/2015 Monteiro ..... F23N 3/002 431/12
2015/0300640 A1 * 10/2015 Smith ..... F23N 3/082 431/12
2017/0082320 A1 * 3/2017 Wang ..... F23N 5/123
2018/0052023 A1 * 2/2018 Yokohata ..... G01F 15/04
2018/0094807 A1 * 4/2018 Lochschmied ..... F23N 5/184
2018/0094808 A1 * 4/2018 Lochschmied ..... F04D 29/4226
2019/0003866 A1 * 1/2019 Kitano ..... G01F 3/22
2019/0024891 A1 * 1/2019 Kitano ..... G01F 15/00
2019/0376687 A1 * 12/2019 Super ..... F23N 1/022

FOREIGN PATENT DOCUMENTS

DE 102005011021 A1 * 9/2006 ..... F23N 5/242
DE 102007009302 A1 9/2007
EP 1921392 A2 5/2008
EP 2888530 A1 7/2015
JP 2017116385 A * 6/2017 ..... F23N 5/18
JP 2017125759 A * 7/2017 ..... F23N 5/18
JP 2017134001 A * 8/2017 ..... G01F 15/046

OTHER PUBLICATIONS

"DE_102007009302_A1_M—Machine Translation.pdf", machine translation, EPO.org, Sep. 30, 2021. (Year: 2021).*
"_IP17046717ProQuestIPcomSearchHistory20220429-20220429.pdf", ProQuest search, Apr. 29, 2022.*
International Search Report for PCT/EP2019/073231, dated Oct. 8, 2019.

* cited by examiner

METHOD FOR REGULATING A HEATING DEVICE AND HEATING DEVICE

FIELD

The present invention relates to a method for regulating a heating device which includes a combustion chamber, into which combustion air is introduced via a controllable blower.

BACKGROUND INFORMATION

European Patent No. EP 2 888 530 B1 describes a method for regulating a heating device, which includes a combustion chamber into which combustion air is introduced via a controllable blower. In the described method, a static pressure and/or a power consumption and also a speed of the blower are measured. A pressure coefficient and/or a power coefficient is determined from the measured static pressure and/or the measured power consumption in conjunction with the measured speed. A volume flow coefficient, from which a volume flow of the combustion air is in turn determined, is determined on the basis of the determined pressure coefficient and/or the determined power coefficient with the aid of reference values for the pressure coefficient and/or the power coefficient.

SUMMARY

Example embodiments of the present invention may have the advantage over the related art that a calibration of the reference values for the operating coefficient, for example, a pressure coefficient and/or a power coefficient, is carried out, whereby deviations, which may occur, for example, due to signs of wear and/or friction losses at the blower, may be taken into consideration.

Advantageous refinements of the present invention are possible due to the features described herein. It is thus advantageous if the reference values for the operating coefficient are stored as a function of the volume flow coefficient, preferably in the form of a characteristic curve, the reference values for the operating coefficient, in particular the characteristic curve, being adapted by the calibration.

Furthermore, it is advantageous if the calibration is carried out on the basis of a calibration function, whereby the calibration may also be adapted comparatively simply.

It is particularly advantageous if a calibration parameter is determined for the calibration, whereby a particularly efficient calibration may be carried out during an operation of the heating device.

It is advantageous if the blower is set to a first speed, which preferably corresponds to a large volume flow, and a first operating coefficient is determined, whereby a starting value for a calibration may be ascertained particularly simply.

It is also advantageous if a second speed is determined for a desired, preferably small volume flow from a relationship which is based on a constant ratio between volume flow and speed, whereby a second speed for a desired volume flow may be ascertained with little computing time.

It is particularly advantageous if the blower is set to the second speed, preferably corresponding to the small volume flow, and a second operating coefficient is determined, whereby a suitable comparative value for the calibration may be provided particularly simply.

The calibration parameter is determined in an advantageous way from a comparison between the first operating coefficient and the second operating coefficient, whereby a particularly simple determination of the calibration parameter is enabled.

It is particularly advantageous if the calibration is carried out when the heating device is connected to a power grid, and/or a sensor, preferably an ionization sensor, detects an unexpected flame behavior in the combustion chamber, whereby a particularly efficient and safe operation of the heating device is enabled.

The present invention also relates to a heating device which is designed to be operated using a method according to the preceding description, whereby the efficiency and the safety of the heating device are increased.

BRIEF DESCRIPTION OF THE DRAWINGS

Exemplary embodiments of the present invention are schematically shown in the figures and explained in greater detail below.

DETAILED DESCRIPTION OF EXAMPLE EMBODIMENTS

Figure 1:
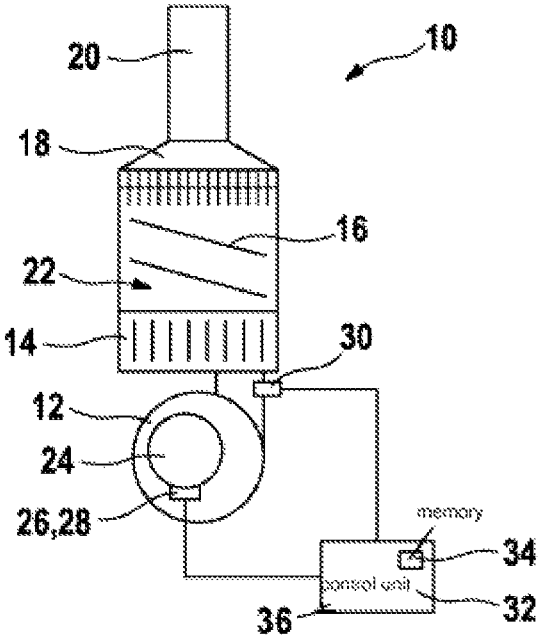
FIG. 1 shows a schematic representation of an exemplary embodiment of a heating device.

A schematic representation of an exemplary embodiment of a heating device 10 is shown in FIG. 1. Heating device 10 includes a blower 12, a burner 14, a heat exchanger 16, an exhaust duct 18, and an exhaust pipe 20. Combustion air is conveyed into a combustion chamber 22 of the heating device via blower 12. Burner 14 and heat exchanger 16 are also situated in the combustion chamber. Fuel, for example, a gas, is conveyed to burner 14. The heat released in burner 14 is transferred to a heating medium, for example, heating water, in heat exchanger 16.

In the exemplary embodiment shown, heating device 10 includes a pressure sensor 30 and a speed sensor 26, which are connected to a control unit 32. According to the present method, a static pressure h, which represents an operating variable of heating device 10, is measured with the aid of pressure sensor 30. A speed N of blower 12 or of a blower wheel 24 is in turn measured with the aid of speed sensor 26. In the case shown, the speed sensor is a Hall sensor 28.

An operating coefficient, in the present case a pressure coefficient H, is determined with the aid of control unit 32 on the basis of measured static pressure h and measured speed N on the basis of the following formula:

$$H = \frac{g \times h}{N^2 \times D^2} \tag{1}$$

In this equation, g is the gravity acceleration and D is the diameter of blower wheel 24 of blower 12. Both variables are known and are stored in a memory 34 of control unit 32.

Subsequently, a volume flow coefficient F is determined on the basis of reference values for the operating coefficient, in the present case for pressure coefficient H.

The reference values for the operating coefficient, in the present case pressure coefficient H, are stored as a function of volume flow coefficient F in memory 34 of control unit 32. The reference values were ascertained on a reference blower having at least similar geometrical dimensions as blower 12.

Finally, a volume flow $\dot{V}$ of the combustion air is determined on the basis of volume flow coefficient F with the aid of the following formula:

$$F = \frac{\dot{V}}{N \times D^3} \tag{2}$$

Volume flow $\dot{V}$ may thus be determined relatively simply on the basis of a measurement of the operating variable, in the present case static pressure h, of heating device 10 and speed N of blower 12. Due to the knowledge of volume flow $\dot{V}$, it is now also possible to adapt it via a corresponding activation of blower 12 to the quantity of supplied fuel, so that a clean and low-emission combustion may take place.

Figure 2:
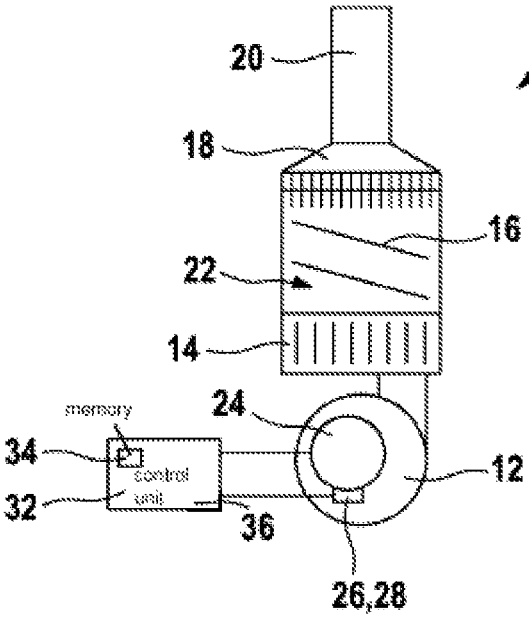
FIG. 2 shows a schematic representation of a further exemplary embodiment of a heating device.

A schematic representation of a further exemplary embodiment of a heating device 10 is shown in FIG. 2. Heating device 10 shown is slightly modified in relation to heating device 10 shown in FIG. 1. Identical and corresponding elements are provided with identical reference numerals.

In addition to the detection of speed N of blower 12 via speed sensor 26, in this exemplary embodiment a power consumption W, which also represents an operating variable of heating device 10, is measured via a power sensor 36. Power consumption W is a power W which is supplied to a motor of blower 12. Power sensor 36 is located here inside control unit 32.

An operating coefficient, in the present case a power coefficient P, is determined with the aid of control unit 32 on the basis of measured power consumption W and measured speed N on the basis of the following formula:

$$P = \frac{W}{\rho \times N^3 \times D^5} \tag{3}$$

In this equation, ρ is the density of the combustion air and D is the diameter of blower wheel 24. Diameter D of blower wheel 24 is known and is stored in memory 34 of control unit 32. Density ρ of the combustion air is considered to be constant via an assumption and is stored as a fixed value, as in the present case of 1.2928 g/dm$^3$ for air, in the memory unit. Alternatively, however, it would also be possible that density p of the combustion air is determined as a function of temperature T of the combustion air and/or static pressure h. Static pressure h could thus also be measured for the exemplary embodiment in FIG. 2 using a pressure sensor 30 as in FIG. 1. Temperature T of the combustion air could be measured using a temperature sensor which is situated upstream from the burner.

A volume flow coefficient F is subsequently determined on the basis of reference values for the operating coefficient, in the present case for power coefficient P.

The reference values for the operating coefficient, in the present case power coefficient P, are stored as a function of volume flow coefficient F in a memory 34 of control unit 32. The reference values were ascertained on a reference blower having at least similar geometrical dimensions as blower 12.

Finally, a volume flow of the combustion air is determined on the basis of volume flow coefficient F with the aid of formula (4).

Volume flow $\dot{V}$ may thus also be determined relatively simply for the exemplary embodiment of heating device 10 from FIG. 2 on the basis of a measurement of the operating variable, in the present case power coefficient P, of heating device 10 and speed N of blower 12. Due to volume flow $\dot{V}$ being known, it is now also possible for this exemplary embodiment to adapt it via a corresponding activation of blower 12 to the quantity of supplied fuel, so that a clean and low-emission combustion may take place.

Figure 3:
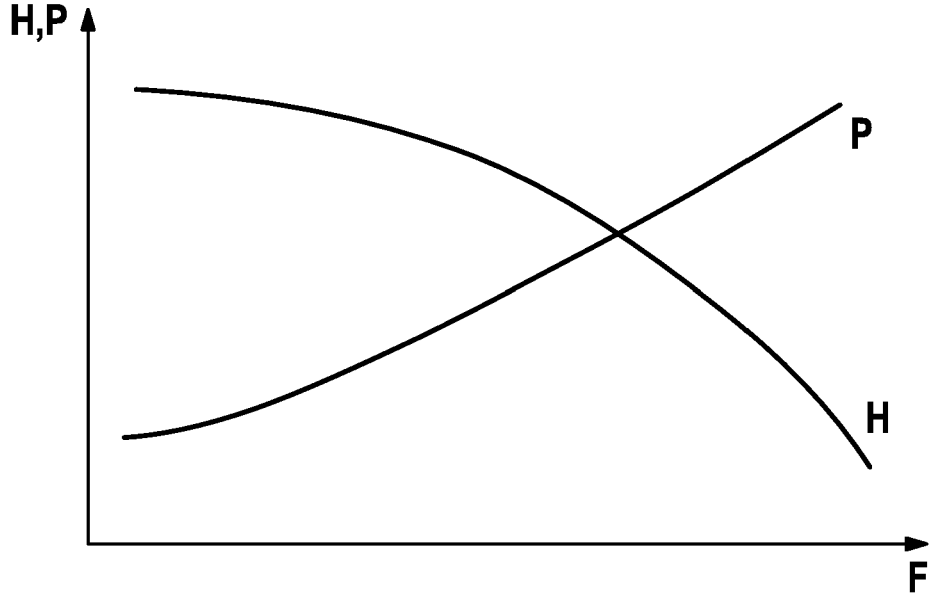
FIG. 3 shows a schematic representation of possible characteristic curves for pressure coefficient H and power coefficient P.

In both exemplary embodiments, the reference values for the operating coefficients are stored as characteristic curves as a function of volume flow coefficient F in memory 34 of control unit 32. Accordingly, characteristic curves for pressure coefficient H and a power coefficient P are schematically shown in FIG. 3.

The present method has the advantage that a calibration of the reference values for the operating coefficient is carried out. Changes in speed N of blower 12, which may occur due to wear, for example, at a bearing of blower wheel 24, may thus be taken into consideration, whereby volume flow $\dot{V}$ may be determined more accurately. Due to the more accurate determination of volume flow $\dot{V}$, the ratio between supplied combustion air and supplied fuel may in turn be regulated more precisely, whereby the combustion may take place even more cleanly and with lower emissions. The efficiency and moreover also the safety of the heating device are thus enhanced by the present method.

This calibration may be carried out both for the reference values of pressure coefficient H and for the reference values of power coefficient P. To avoid repetition, however, only the calibration of the reference values of power coefficient P for the exemplary embodiment from FIG. 2 are to be discussed hereafter. A calibration of the reference values of pressure coefficient H for the exemplary embodiment from FIG. 1 is carried out similarly.

The calibration of the reference values of power coefficient P is carried out on the basis of a calibration function $f_2(A_2)$, from which a calibrated power coefficient $\hat{P}$ results:

$$\hat{P} = (P + (c_1 + c_2 \cdot f_1(A_1))) \cdot \frac{1}{f_2(A_2)} \tag{4}$$

Parameters $c_1$ and $c_2$ are set manually during the manufacture of heating device 10 for blower 12.

Function $f_1(A_1)$ is an adaptation function, due to which specific properties of present blower 12 are taken into consideration. In the present exemplary embodiment, it reads:

$$f_1(A_1) = A_1 \cdot c_3 + c_4 \tag{5}$$

In this equation, $c_3$ and $c_4$ are parameters, which are set depending on the type of utilized blower 12 during the manufacture of heating device 10. In the present case, $c_3$=0.025 and $c_4$=0.5.

Parameter $A_1$ is an adaptation parameter and is also set manually during the manufacture of heating device 10 for blower 12 and enables the specific properties of present blower 12 to be taken into consideration, since manufacturing-related differences may occur even in the case of individual blowers of the same type.

In contrast, function $f_2(A_2)$ is a calibration function, due to which signs of wear, for example, at a bearing of blower 12, are taken into consideration. In the present exemplary embodiment, it reads:

$$f_2(A_2) = \left[\left(2\cdot\left(\frac{\dot{V}-\dot{V}_{low}}{\dot{V}_{high}-\dot{V}_{low}}\right)-\left(\frac{\dot{V}-\dot{V}_{low}}{\dot{V}_{high}-\dot{V}_{low}}\right)^2\right)\cdot(20-A_2)+A_2\right]\cdot c_5+c_6 \tag{6}$$

In this equation, $c_5$ and $c_6$ are parameters, which are set depending on the type of utilized blower 12 during the manufacture of heating device 10. The calibration function may thus be adapted to the wear behavior of the blower. In the present case, $c_5$=0.035 and $c_6$=0.3.

Parameter $A_2$ is a calibration parameter and is determined with the aid of the present method, whereby a particularly efficient calibration may be carried out during the operation of heating device 10. Signs of wear are thus taken into consideration in the presently occurring extent, whereby a particularly accurate regulation of heating device 10 may take place.

In a first method step, blower 12 is set to a first speed $N_{high}$, preferably corresponding to a high volume flow $\dot{V}_{high}$, and a first power coefficient $P_{high}$ is determined. Influences resulting from wear are less noticeable at high speeds of blower 12 than at low speeds. This circumstance may advantageously be used by a determination of power coefficient $P_{high}$ at a high speed $N_{high}$, whereby a good starting point for a calibration is created.

Blower 12 is preferably set to first speed $N_{high}$ between 3000 and 6000 RPM, in the case shown of 5000 RPM. A particularly efficient determination of power coefficient $P_{high}$ is thus enabled.

In the present case, at set first speed $N_{high}$, power consumption $W_{high}$ of blower 12 is measured, whereupon power coefficient $P_{high}$ is determined in conjunction with set first speed $N_{high}$ and measured power consumption $W_{high}$ with the aid of formula (3).

In addition, a volume flow coefficient $F_{high}$ is then determined from power coefficient $P_{high}$ with the aid of the present reference values or characteristic curves (FIG. 3) for power coefficient P. A first volume flow $\dot{V}_{high}$ is then determined from volume flow coefficient $F_{high}$ with the aid of formula (2).

In a further method step, a second speed $N_{low}$ for a desired volume flow $\dot{V}_{low}$, which is low in the present case, is determined from a relationship which is based on a constant ratio between volume flow $\dot{V}$ and speed N as follows:

$$\frac{\dot{V}_{low}}{N_{low}} = \frac{\dot{V}_{high}}{N_{high}} = const. \tag{7}$$

In the present case, desired volume flow $\dot{V}_{low}$ is established. Second speed $N_{low}$ is then determined with the aid of the relationship described in formula (7), desired volume flow $\dot{V}_{low}$, previously determined first volume flow $\dot{V}_{high}$, and already known first speed $N_{high}$, as follows:

$$N_{low} = \frac{\dot{V}_{high}}{N_{high}}\cdot\dot{V}_{low} \tag{8}$$

Second speed $N_{low}$ may thus be determined particularly simply, little computing time being required.

Figure 4:
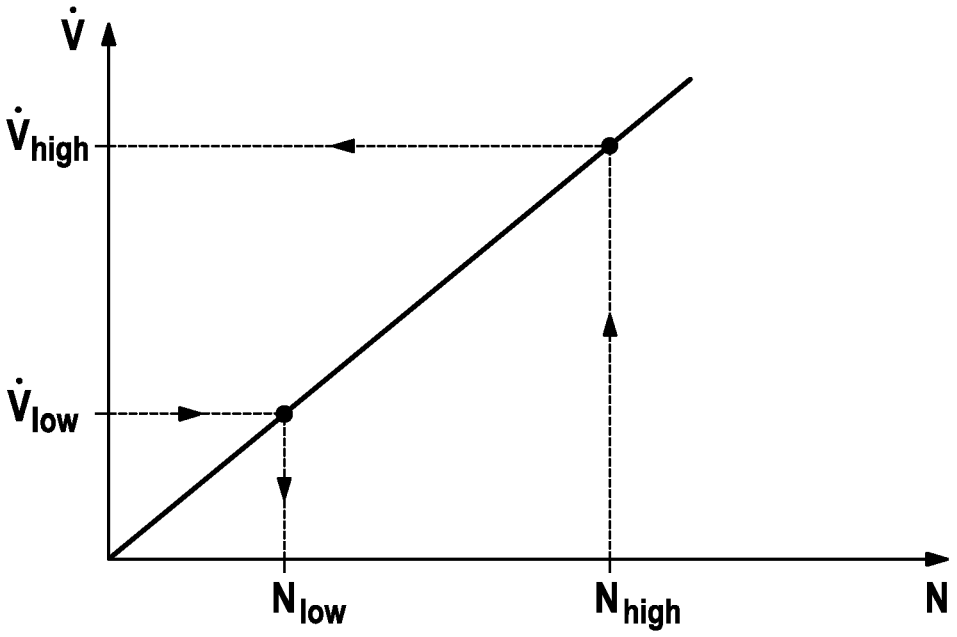
FIG. 4 shows a schematic representation of the relationship between volume flow $\dot{V}$ and speed N.

A schematic representation of the relationship between volume flow $\dot{V}$ and speed N is accordingly shown in FIG. 4. As already described, a constant ratio between volume flow $\dot{V}$ and speed N is provided for the present method. The arrows indicate the way in which second speed $N_{low}$ is determined according to the preceding description. It may also be seen that desired volume flow $\dot{V}_{low}$ in the present case is less than first volume flow $\dot{V}_{low}$. Accordingly, in the present case second speed $N_{low}$ is less than first speed $N_{high}$.

In a further method step, blower 12 is set to second speed $N_{low}$ corresponding in the present case to minimal volume flow $\dot{V}_{low}$, and a second operating coefficient $P_{low}$ is determined. The circumstance may advantageously be utilized here that influences resulting from wear are more strongly noticeable at low speeds. A comparative value suitable for a calibration may thus be ascertained particularly simply by the determination of power coefficient $P_{low}$ at a low speed $N_{low}$.

Blower 12 is preferably set to second speed $N_{low}$ between 920 and 1700 RPM, in the case shown of 1000 RPM. A particularly efficient determination of power coefficient $P_{low}$ is thus enabled.

In the present case, power consumption $W_{low}$ of blower 12 is measured at set second speed $N_{low}$, whereupon power coefficient $P_{low}$ is determined in conjunction with set second speed $N_{low}$ and measured power consumption $W_{low}$ with the aid of formula (3).

In a further method step, the calibration parameter is determined from a comparison between first operating coefficient $P_{high}$ and second operating coefficient $P_{low}$, whereby a particularly simple determination of the calibration parameter is enabled with little computing time.

In the present case, the comparison between first power coefficient $P_{high}$ and second power coefficient $P_{low}$ is carried out in that a ratio, in particular a quotient, is formed from second power coefficient $P_{low}$ and first power coefficient $P_{high}$, an adaptation to the above-described specific properties of present blower 12 being carried out in each case for both of them:

$$f_2(A_2) = \frac{(P_{low}+(c_1-c_2\cdot f_1(A_1)))}{(P_{high}+(c_1-c_2\cdot f_1(A_1)))} \tag{9}$$

The following in turn results from formula (6) with $\dot{V}=\dot{V}_{low}$:

$$f_2(A_2)=A_2\cdot c_5+c_6 \tag{10}$$

Parameters $c_5$ and $c_6$ are already known, since they are set as described above during the manufacture of heating device 10. If one now inserts the value for $f_2(A_2)$ ascertained with the aid of equation (9) into equation (10), calibration parameter $A_2$ may thus be numerically determined.

With the aid of calibration parameter $A_2$ determined by the present method, the reference values stored in the memory for the power coefficient or the characteristic curve may be calibrated with the aid of formulas (4) through (6), whereby changes in speed N of blower 12 which may occur due to wear, for example, at a bearing of blower wheel 24, may be taken into consideration and whereby volume flow $\dot{V}$ may in turn be determined more accurately.

Figure 5:
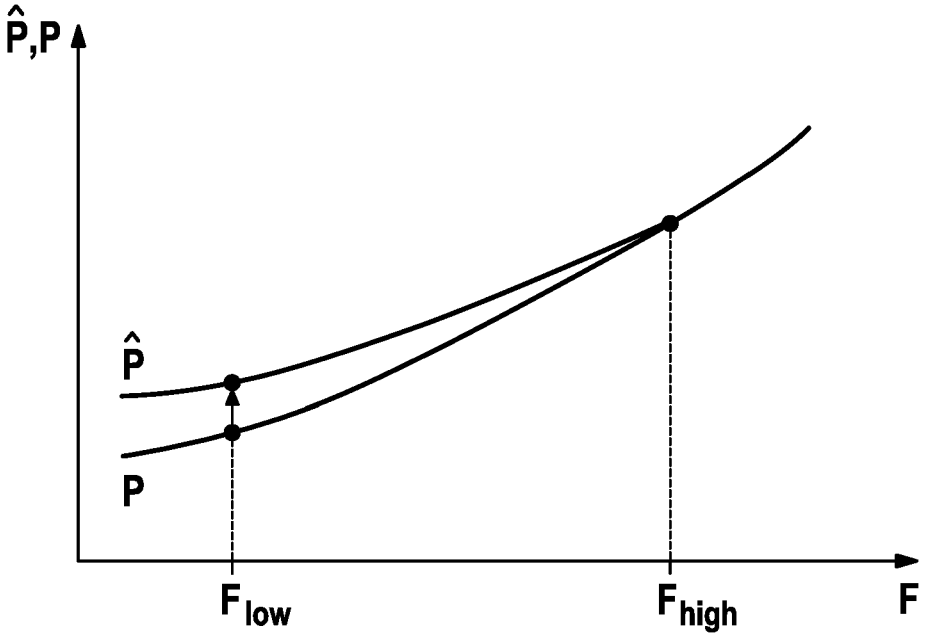
FIG. 5 shows a schematic representation of a calibrated characteristic curve including calibrated power coefficient $\hat{P}$ in comparison to a non-calibrated characteristic curve including power coefficient P.

A schematic representation of a calibrated characteristic curve including calibrated power coefficient $\hat{P}$ in comparison to a non-calibrated characteristic curve including non-calibrated power coefficient P is accordingly shown in FIG. 5. Volume flow coefficients $F_{low}$ and $F_{high}$ are plotted for the sake of illustration, which are determinable via formula (2) for corresponding volume flows $\dot{V}_{low}$ and $\dot{V}_{high}$. It is apparent that a more intense calibration results for lower volume flows than for higher volume flows. A very realistic calibration is thus enabled by the present method.

In the present method, the calibration is then always carried out when heating device 10 is connected to a power grid or when a sensor, for example, an ionization sensor, detects an unexpected flame behavior in the combustion chamber; a particularly efficient and safe operation of heating device 10 is thus enabled.

What is claimed is:

1. A method for regulating a heating device, the heating device including a combustion chamber into which combustion air is introduced via a controllable blower, the method comprising the following steps:

measuring an operating variable and a speed of the blower;

determining an operating coefficient based on the measured operating variable and the measured speed;

determining a volume flow coefficient based on reference values for the operating coefficient;

determining a volume flow of the combustion air based on the volume flow coefficient; and carrying out a calibration of the reference values for the operating coefficient, wherein the calibration takes place using a calibration function which is configured to be adapted to a wear behavior of the blower.

2. The method as recited in claim 1, wherein the reference values for the operating coefficient are stored as a function of the volume flow coefficient in the form of a characteristic curve, the characteristic curve, being adapted by the calibration.

3. The method as recited in claim 1, wherein a calibration parameter is determined for the calibration.

4. The method as recited in claim 3, wherein the blower is set to a first speed and a first operating coefficient s determined.

5. The method as recited in claim 4, wherein a second speed for a desired volume flow is determined from a relationship which is based on a constant ratio between volume flow and speed.

6. The method as recited in claim 5, wherein the blower is set to the second speed corresponding to the desired volume flow, and a second operating coefficient is determined.

7. The method as recited in claim 6, wherein the calibration parameter is determined from a comparison between the first operating coefficient and the second operating coefficient.

8. The method as recited in claim 1, wherein the calibration is carried out when the heating device is connected to a power grid and/or an ionization sensor detects an unexpected flame behavior in the combustion chamber.

9. A heating device, comprising:

a combustion chamber into which combustion air is introduced via a controllable blower;

wherein the heating device is configured to:

measuring an operating variable and a speed of the blower;

determine an operating coefficient based on the measured operating variable and the measured speed;

determine a volume flow coefficient based on reference values for the operating coefficient;

determine a volume flow of the combustion air based on the volume flow coefficient; and carry out a calibration of the reference values for the operating coefficient, wherein the calibration takes place using a calibration function which is configured to be adapted to a wear behavior of the blower.

* * * * *